US007114721B2

(12) United States Patent
Micarelli

(10) Patent No.: US 7,114,721 B2
(45) Date of Patent: Oct. 3, 2006

(54) PATTERN FORMATION BOARD GAME

(75) Inventor: Paul Micarelli, Malaga, NJ (US)

(73) Assignee: 3 Amoebas, Inc., Williamstown, NJ (US)

( * ) Notice: Subject to any disclaimer, the term of this patent is extended or adjusted under 35 U.S.C. 154(b) by 0 days.

(21) Appl. No.: 11/026,628

(22) Filed: Dec. 31, 2004

(65) Prior Publication Data

US 2006/0145420 A1 Jul. 6, 2006

(51) Int. Cl.
*A63F 3/00* (2006.01)

(52) U.S. Cl. ..... 273/242; 273/282.1

(58) Field of Classification Search ..... 273/242, 273/282.1, 284, 287, 267; D21/362
See application file for complete search history.

(56) References Cited

U.S. PATENT DOCUMENTS 214,048 A 4/1879 Macy
636,109 A * 10/1899 Bowers ..... 273/155
2,520,207 A * 8/1950 Graham ..... 273/242
3,655,194 A * 4/1972 Pierson ..... 273/258
4,146,235 A 3/1979 Brautovich
5,080,368 A * 1/1992 Weisser ..... 273/241
5,524,897 A * 6/1996 Mastronunzio ..... 273/264
5,839,729 A 11/1998 Watanabe

* cited by examiner

*Primary Examiner*—Vishu K. Mendiratta
(74) *Attorney, Agent, or Firm*—Michael Crilly, Esq.

(57) ABSTRACT

A pattern formation board game and method of play are presented. The present invention includes a board having a play area with a plurality of overlapping substantially circular patterns thereon. Circular patterns are composed of a plurality of interlocking spaces including two geometric shapes. Game pieces are substantially identical in shape and size to the geometric shapes on the game board. Game pieces are placed onto likewise-shaped spaces so as to form overlapping primary and second geometric patterns. A player declares any primary and secondary patterns formed after placement of a game piece, records a pattern as a tally mark on a score sheet, and calculates a total score after no further primary patterns are possible.

18 Claims, 10 Drawing Sheets

| NAME | SCORE SHEET | | | | | | NAME |
|---|---|---|---|---|---|---|---|
| PLAYER 1 | SCORE TALLY | VALUE | POINTS | PLAYER 2 | SCORE TALLY | VALUE | POINTS |
| | TRIANGLE | 1 | | | TRIANGLE | 1 | |
| | DIAMOND | 1 | | | DIAMOND | 1 | |
| | GEM | 5 | | | GEM | 5 | |
| | EYE | 5 | | | EYE | 5 | |
| | PYRAMID | 10 | | | PYRAMID | 10 | |
| | HOURGLASS | 10 | | | HOURGLASS | 10 | |
| | STAR | 10 | | | STAR | 10 | |
| | CIRCLE | 25 | | | CIRCLE | 25 | |
| | FLOWER | 25 | | | FLOWER | 25 | |
| TOTALS | | | | TOTALS | | | |

20

*Fig. 21*

PATTERN FORMATION BOARD GAME

CROSS REFERENCE TO RELATED APPLICATIONS

None.

FEDERALLY SPONSORED RESEARCH OR DEVELOPMENT

None.

BACKGROUND OF INVENTION

1. Field of the Invention

The present invention relates to a board game whereby players compete to complete defined patterns and score points. Specifically, the invention includes a play area having a plurality of overlapping substantially circular patterns thereon. Circular patterns are composed of a plurality of interlocking spaces including two shapes. Game pieces are placed onto likewise-shaped spaces so as to form one or more completely overlapping geometric patterns, each having a point value totaled to determine the game points awarded.

2. Description of the Related Art

Pattern formation games are described in the related arts. Presently known games include game pieces having sides composed of single linear segments and game board spaces composed of a single geometric shape arranged to form a single geometric pattern. Linear-based game boards and pieces limit the variety of geometric patterns achievable during play and therefore preclude embedded secondary geometric patterns within a larger primary pattern. As such, the related arts include design features and methods of play to offset the limitations, constraints, and deficiencies imposed by linear-based board games.

For example, the complexity and challenge of a pattern formation board game may reside with surface ornamentation to limit the placement of game pieces. Macy, U.S. Pat. No. 214,048, describes and claims a board game composed of six hexagons having six equilateral triangles therein and thirty-six equilateral games pieces with one to six dots along each side. Brautovich, U.S. Pat. No. 4,146,235, describes and claims a board game composed of seven equal sized hexagonal areas each having six equilateral triangles therein and a plurality of triangular-shaped game pieces with one to three dots along each side. Methods of play include the placement of game pieces so as to match the number of dots between abutting game pieces. As such, the primary objective of the both games is numerical matching within the constraints of defined patterns rather than pattern formation.

In another example, the complexity and challenge of a pattern formation board game may reside with the completion of two partially-overlapping patterns. Mastronunzio, U.S. Pat. No. 5,524,897, describes and claims a board game having a hexagonal playing surface composed of a plurality of isosceles triangles. A method of play includes the placement of colored game pieces onto the described board by each player so as to substantially occupy star-shaped patterns and row-shaped patterns overlapping at least two star patterns. Points are awarded for having more game pieces covering a star shaped pattern than other players, for having more playing pieces covering a row of spaces than other players, for the total number of playing pieces on the playing surface, for completely occupying a star, and for completely occupying a row. The described triangular-shaped game pieces and spaces and star-shaped patterns thereof preclude the formation of patterns with smaller sub-patterns therein.

In yet another example, the complexity and challenge of a board game may reside with the formation of arbitrary shapes traversing two or more patterns of a single defined shape. Watanabe, U.S. Pat. No. 5,839,729, describes and claims a board game having a regular periodic pattern of seven identical hexagonal frames, each composed of twenty-four equilateral triangles. A method of play includes placing one of several polygonal-shaped playing pieces, namely, triangles, rhombi, trapezoids, and hexagons, onto a playing surface so that a newly added game piece completely abuts a side along one or more game pieces with which it contacts. A player scores points by completely filling a hexagonal frame, irrespective of the color of the other games pieces therein, as it is unlikely that one player would exclusively occupy a single frame. The described triangular-shaped game pieces and spaces and hexagonal-shaped patterns thereof preclude the formation of patterns with smaller sub-patterns therein.

What is required is a complex and challenging board game enabling the formation of a variety of defined patterns by the assemblage of two interlocking game pieces.

Furthermore, what is required is a complex and challenging game board and method of play enabling players to score points by forming a defined pattern and one or more smaller defined patterns therein.

SUMMARY OF INVENTION

An object of the present invention is to provide a complex and challenging board game enabling the formation of a variety of defined patterns by the assemblage of two interlocking game pieces.

A further object of the present invention is to provide a complex and challenging game board and method of play enabling players to score points by forming a defined pattern and one or more smaller defined patterns therein, each composed of interlocking game pieces.

The present invention includes a board having a play area substantially planar in extent, a plurality of overlapping substantially circular patterns disposed on the play area, a plurality of first game pieces, and a plurality of second game pieces. Each circular pattern is defined by a boundary having therein a plurality of first spaces each having a symmetric perimeter composed of a pair of convex sides and a plurality of second spaces each having a perimeter composed of three concave sides. The concavity and convexity of defined sides are substantially similar. Each second space is surrounded by three first spaces. First game pieces are substantially identical in shape and size to the first spaces. Second game pieces are substantially identical in shape and size to the second spaces. First and second game pieces are provided in two or more separate colors to simplify pattern recognition between players. In some embodiments of the present invention, one or more receptacles are provided on the play area for the temporary storage of game pieces during play.

A method of play is described and claimed including the steps of providing the above described board, plurality of first game pieces, and plurality of second game pieces, dividing first and second game pieces between at least two players based upon the color coding thereof, placing a first game piece onto a first space or a second game piece onto a second space in a sequential order of play, declaring the formation of a primary pattern and any secondary patterns, recording primary and secondary patterns as a tally mark on a score sheet, and calculating a total score for each player after no further primary patterns are possible. In some embodiments of the present invention, the calculating step may include calculating a product by multiplying the total number of tally marks by a point value for each primary and secondary pattern and summing the products thereof The described invention provides several advantages over the related arts. The invention is easier to learn and play, yet sufficiently sophisticated and flexible to appeal to a wide range of age groups. The game board offers a wider variety of scoring options so as to increase the level of competition.

BRIEF DESCRIPTION OF DRAWINGS

FIG. 21 is a plan view of an exemplary score sheet.

REFERENCE NUMERALS

| | |
|---|---|
| 1 | Board game |
| 2 | Board |
| 3 | Play area |
| 4a–4d | Receptacle |
| 5 | Boundary |
| 6 | First game piece |
| 7 | Second game piece |
| 8 | Triangle pattern |
| 9 | Diamond pattern |
| 10 | Gem pattern |
| 11 | Eye pattern |
| 12 | Pyramid pattern |
| 13 | Hourglass pattern |
| 14 | Star pattern |
| 15 | Circle pattern |
| 16 | Flower pattern |
| 17 | Incomplete pattern |
| 18 | Primary pattern |
| 19 | Secondary pattern |
| 20 | Score sheet |
| 21 | First space |
| 22 | Second space |
| 23a–23c | Concave side |
| 24a–24b | Convex side |
| 25a–25c | Circular pattern |
| 26a–26c | Linear segment |

DETAILED DESCRIPTION OF INVENTION

Figure 1:
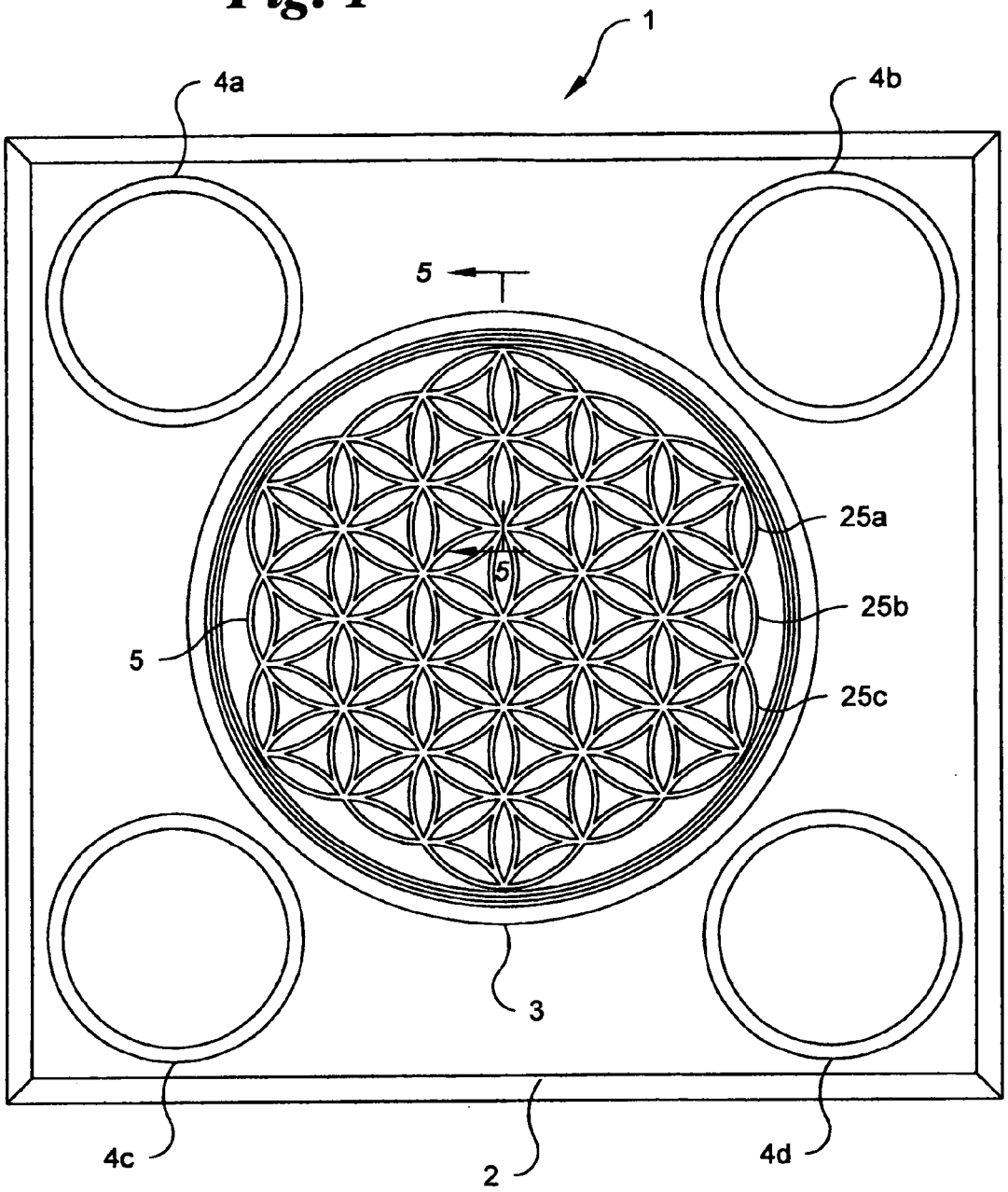
FIG. 1 is a plan view of the game board for an embodiment of the present invention.
Figure 3A:
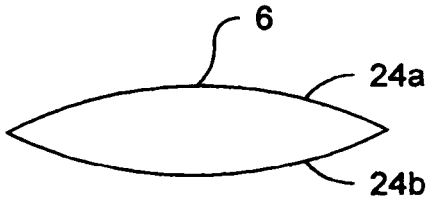
FIG. 3*a* is a plan view of an exemplary oval-shaped first game piece.
Figure 4A:
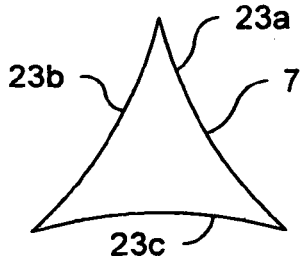
FIG. 4*a* is a plan view of an exemplary triangle-shaped second game piece.

The present board game 1 is composed of a board 2 as described in FIG. 1, a plurality of first game pieces 6 as described in FIG. 3*a*, and a plurality of second game pieces 7 as described in FIG. 4*a*.

Referring now to FIG. 1, the board 2 is a planar structure sufficiently rigid and durable to support a play area 3 and one or more optional receptacles 4*a*–4*d*. The board 2 may be composed of one or more materials, non-limiting examples including paper, plastic, wood, glass, ceramic and metal. It likewise possible for the board 2 to have one or more folds, seams, or cuts that allow it to be folded in a planar-wise fashion to form a more compact shape for storage.

The play area 3 is positioned on the board 2, preferably about the geometric center of the board 2. The play area 3 includes a boundary 5 defining an interlocking pattern thereon and composed of a plurality of overlapping circular patterns 25*a*–25*c*. The boundary 5 may consist of a line image of a defined thickness printed, patterned or scribed onto the surface of the board 2 or onto a flexible material, one example being paper, which is adhesively bonded to the board 2. It is likewise possible for the boundary 5 to be comprised of a single-piece or multi-piece structure composed of a molded plastic of a defined thickness and height. The structure may be either adhesively or mechanically fastened to the board 2. Receptacles 4*a*–4*d* may be likewise printed as an image or comprised of a cup-shaped structure, one example being a molded plastic, fastened to the board 2 adjacent to the play area 3.

Figure 2:
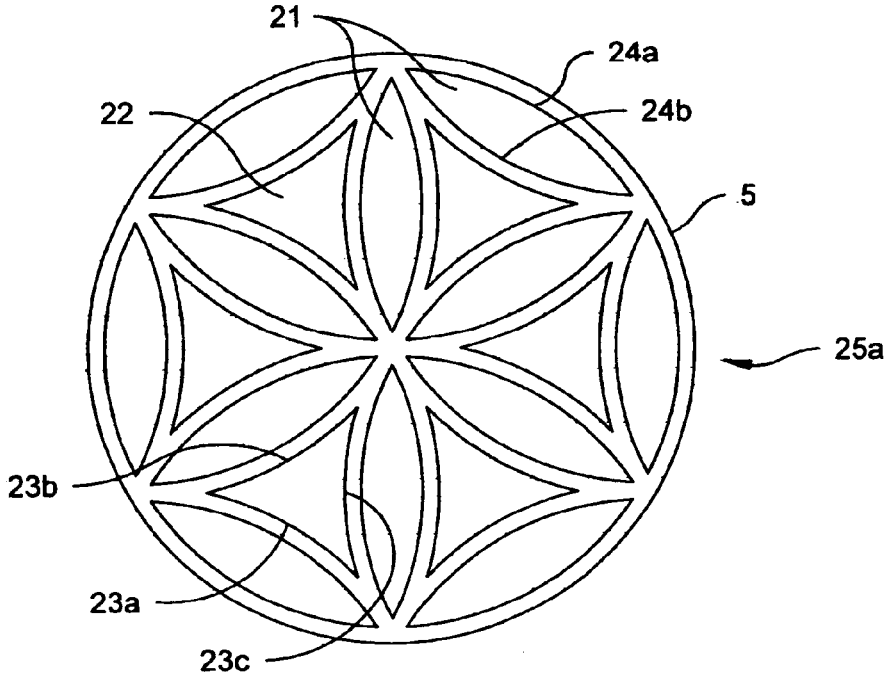
FIG. 2 is a plan view of a single circular pattern shown in FIG. 1.
Figure 6:
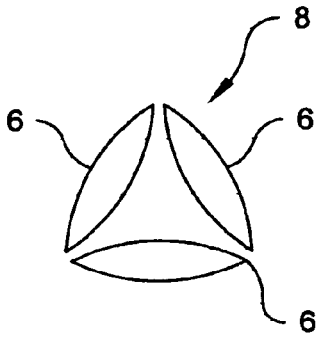
FIG. 6 is a plan view of a triangle pattern composed of three first game pieces.

Referring now to FIG. 2, a preferred embodiment of the circular pattern 25*a* is shown. The boundary 5 clearly defines an interlocking pattern composed of twelve first spaces 21 and six second spaces 22. However, other designs are possible so as to include more or less first spaces 21 and second spaces 22. Each first space 21 is a two-sided design composed of a pair of identically shaped and symmetrically disposed convex sides 24*a*–24*b*. Each convex side 24*a*–24*b* may be composed of a curved or arched line segment, preferably forming an ellipse or oval when both convex sides 24*a*–24*b* are joined end-to-end. Each second space 22 is a three-sided design composed of three identically shaped concave sides 23*a*–23*c*. Each concave side 23*a*–23*c* may be composed of a curved or arched line segment.

As shown in FIG. 2, a first set of six first spaces 21 is aligned lengthwise in an outwardly radial fashion with an inwardly disposed second space 22 between each pair of first spaces 21. A second set of six first spaces 21 is arranged lengthwise and end-to-end so as to form a circle about the first set of first spaces 21 and second spaces 22. The resultant structure aligns a first space 21 in a length fashion parallel to each concave side 23–23*c* comprising each second space 22.

A variety of dimensional lengths may be appropriate to sufficiently interlock each pair-wise arrangement of a concave side 23*a*–23*c* and a convex side 24*a*–24*b* within the boundary 5. It was preferred for each concave side 23*a*–23*c* to have a nominal length of 1.15-inches, each convex side 24*a*–24*b* to have a nominal length of 1.625-inches, each second space 22 to have a nominal width-to-length ratio of 0.23, and the boundary 5 to have a width of 0.1-inches.

Referring again to FIG. 1, embodiments of the present invention may include a variety of numerical and geometric groupings of the defined circular pattern 25*a*–25*c*. In preferred embodiments, a total of nineteen circular patterns 25*a*–25*c* are arranged in an overlapping fashion so as to form five rows with three, four, five, four, and three circular patterns 25*a*–25*c* in the order described.

Referring now to FIG. 3*a*, a first game piece 6 is shown for use on a play area 3 composed of the preferred circular patterns 25*a*–25*c* in FIGS. 1–2. The first game piece 6 is a two-sided design composed of identically shaped and symmetrically disposed convex sides 24*a*–24*b*, as described above for the first spaces 21. Each convex side 24*a*–24*b* may be composed of a curved or arched line segment, preferably forming an ellipse or oval when both convex sides 24*a*–24*b* are joined end-to-end in a closed fashion.

Referring now to FIG. 4*a*, a second game piece 7 is shown for use on a play area 3 composed of circular patterns 25*a*–25*c* in FIGS. 1–2. The second game piece 7 is a three-sided design composed of identically shaped concave sides 23*a*–23*c*. Each concave side 23*a*–23*c* may be composed of a curved or arched line segment joined end-to-end in a closed fashion.

First and second game pieces 6, 7 may be fabricated from one or more materials, non-limiting examples including paper, cardboard, plastic, wood, glass, ceramic, and metal. In some embodiments, it may be preferred to have a small magnet embedded within each first and second game pieces 6, 7 so as to adhere to a metal or metal-clad board 2. It is likewise preferred for each first game piece 6 and each second game piece 7 to be substantially similar in shape and size to each first space 21 and each second space 22, respectively. Furthermore, first and second game pieces 6, 7 may have one or more thicknesses, however, it was preferred that they be of equal and uniform thickness, one example being 0.25-inches.

Figure 3B:
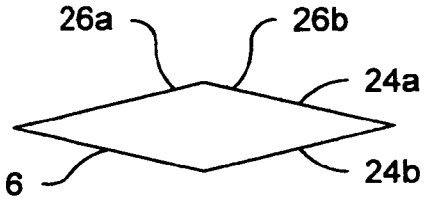
FIG. 3*b* is a plan view of a first game piece having sides composed of two linear segments.
Figure 4B:
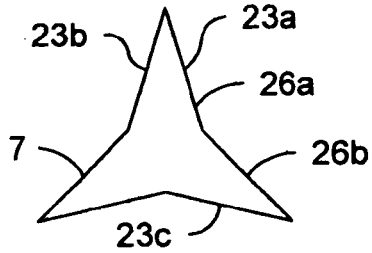
FIG. 4*b* is a plan view of a second game piece having sides composed of two linear segments.
Figure 3C:
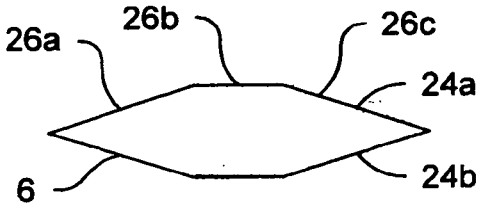
FIG. 3*c* is a plan view of a first game piece having sides composed of three linear segments.
Figure 4C:
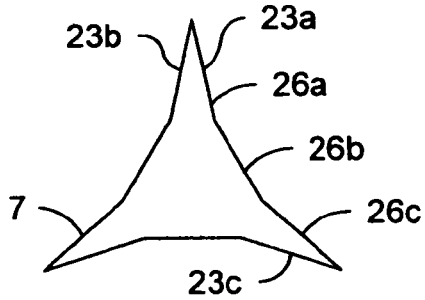
FIG. 4*c* is a plan view of a second game piece having sides composed of three linear segments.

Referring now to FIGS. 3*b*–4*b* and 3*c*–4*c*, alternate embodiments are shown for the first and second game pieces 6, 7 described above. In some embodiments of the present invention, it may be desired for the concave sides 23*a*–23*c* and convex sides 24*a*–24*b* to be composed of two or more segments. For example, FIG. 3*b* shows a first game piece 6 having a pair of convex sides 24*a*–24*b* each composed to two linear segments 26*a*–26*b* in an end-to-end arrangement so as to approximate the oval shape in FIG. 3*a*. FIG. 4 *b* graphically presents the complimentary second game piece 7 also having concave sides 23*a*–23*c* each composed of two linear segments 26*a*–26*b*. In yet another example, FIG. 3*c* shows a first game piece 6 having a pair of convex sides 24*a*–24*b* each composed of three linear segments 26*a*–26*c* joined end-to-end to more closely approximate the oval shape in FIG. 3*a*. FIG. 4*c* graphically presents the complimentary second game piece 7 also having concave sides 23*a*–23*c* each composed of three linear segments 26*a*–26*c*. It is readily apparent from the description of FIGS. 3*b*, 3*c*, 4*b*, and 4*c* that sides composed of four or more linear segments are likewise possible. The described alternate embodiments would require each first space 21 and each second space 22 shown in FIGS. 1–2 to be shaped accordingly.

As the present invention may be played by two or more players or two or more teams of players, it is critical that first and second game pieces 6, 7 be sufficiently distinctive so as to allow for their proper identification and any patterns formed thereof A visual coding based upon color may be used to distinguish all first and second game pieces 6, 7 of one player from another. More specifically, it is possible for first and second game pieces 6, 7 to have a separately distinctive color scheme including one or more colors. For example, it was found that sufficient visual distinction was achieved when forty-five first game pieces 6 and twenty-seven second game pieces 7 were provided having a light color, namely white, and a like number of each having a dark color, namely black, for the play area 3 shown in FIG. 1. It is readily apparent that a wide variety of colors and color schemes are possible.

Figure 5:
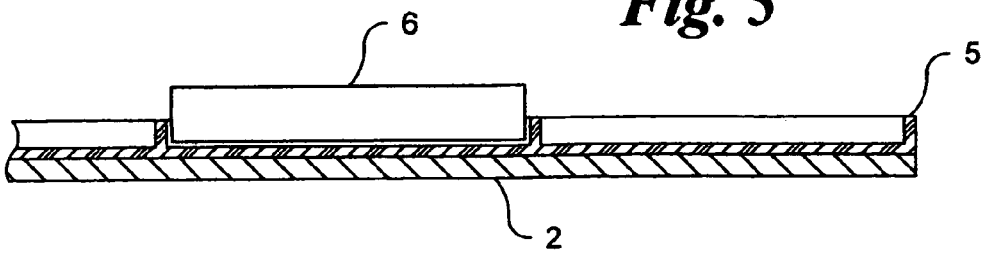
FIG. 5 is a section view of the game board, boundary, and first game piece for an exemplary embodiment having an elevated boundary structure.

Referring now to FIG. 5, the boundary 5 may be comprised of a structure that extends above the board 2 in some embodiments. It is preferred to have the boundary 5 mechanically surround and support each first game piece 6 and each second game piece 7 residing on the play area 3 so as to prevent unwanted movement by the former. It is preferred for the boundary 5 to have a height less than the thickness of the thinnest first and second game pieces 6, 7 so as to allow their placement and removal.

Figure 7:
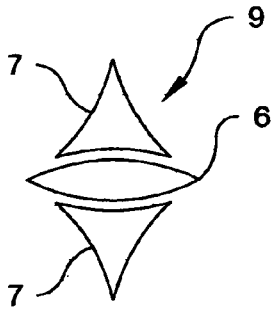
FIG. 7 is a plan view of a diamond pattern composed of two second pieces and one first game piece.
Figure 8:
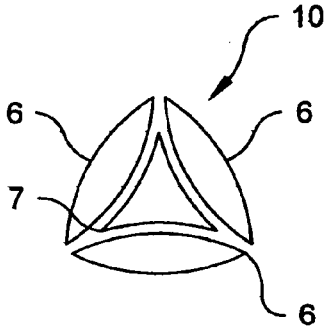
FIG. 8 is a plan view of a gem pattern composed of three first game pieces and one second game piece.
Figure 9:
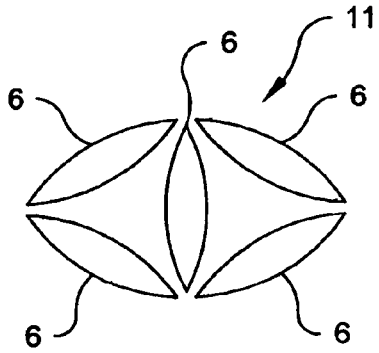
FIG. 9 is a plan view of an eye pattern composed of five first game pieces.
Figure 10:
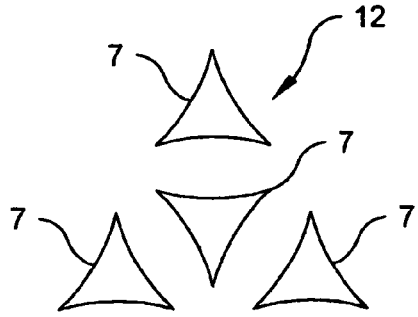
FIG. 10 is a plan view of a pyramid pattern composed of four second game pieces.
Figure 11:
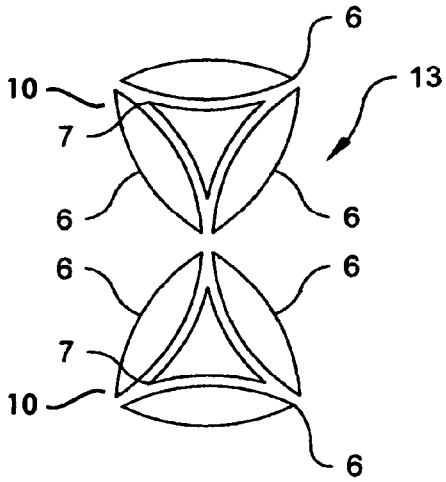
FIG. 11 is a plan view of an hourglass pattern composed of six first game pieces and two second game pieces.

Referring now to FIGS. 6–14, nine primary patterns for scoring purposes are shown for the play area 3 described in FIGS. 1–2. Points are awarded when likewise coded first and/or second game pieces 6, 7 exclusively complete an identified pattern. FIG. 8 describes a gem pattern 10 composed of three first game pieces 6 adjacently disposed about a single second game piece 7. Whereas, FIG. 6 describes a triangle pattern 8 composed of the three first game pieces 6 shown in FIG. 8 absent the second game piece 7. FIG. 9 describes an eye pattern 11, based upon the triangle pattern 8 in FIG. 6, composed of two pairs of first game pieces 6 symmetrically and adjacently disposed about a fifth first game piece 6. FIG. 7 describes a diamond pattern 9 composed of a single first game piece 6 adjacently disposed between a pair of second game pieces 7. FIG. 11 describes an hourglass pattern 13 composed of a pair of symmetrically and adjacently disposed gem patterns 10, each composed of three first game pieces 6 and one second game piece 7. FIG.

Figure 12:
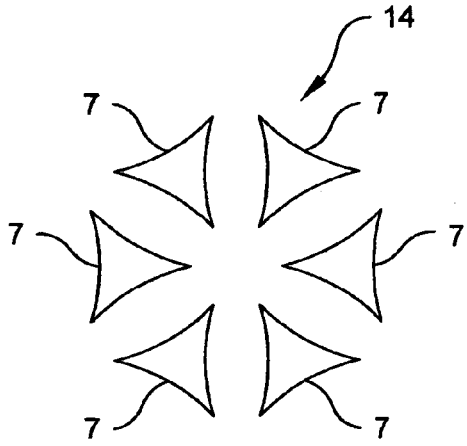
FIG. 12 is a plan view of a star pattern composed of six second game pieces.
Figure 13:
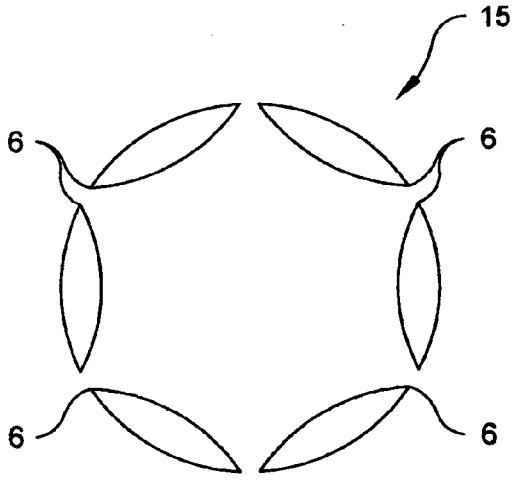
FIG. 13 is a plan view of a circle pattern composed of six first game pieces arranged in a circular fashion.
Figure 14:
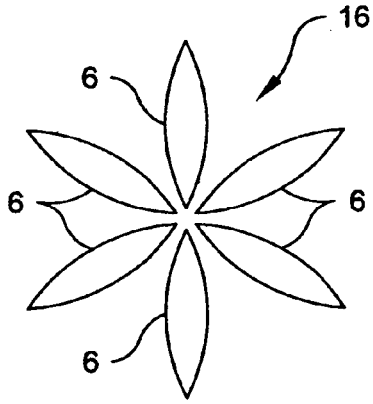
FIG. 14 is a plan view of a flower pattern composed of six first game pieces arranged in a radial fashion.

10 describes a pyramid pattern 12 composed of four second game pieces 7 wherein the centermost second game piece 7 is oriented in a direction opposite of the others. FIG. 12 describes a star pattern 14 composed of six second game pieces 7 arranged in a circular fashion. FIG. 13 describes a circle pattern 15 composed of six first game pieces 6 adjacently disposed and arranged to form a circle. FIG. 14 describes a flower pattern 16 composed of six first game pieces 6 arranged in an outwardly disposed and radial fashion. FIGS. 12–14 form the circular pattern 25*a* shown in FIG. 2 when overlaid.

Referring now to FIGS. 15–20, primary patterns 18 and secondary patterns 19 are described for the completion of an otherwise incomplete pattern 17. Secondary patterns 19, for the purpose of this description, include the triangle pattern 8 in FIG. 6 and the gem pattern 10 in FIG. 8. The patterns provided below are exemplary, as other play and scoring options are possible. A total point score is calculated for each play option in FIGS. 15–20 by summing the point values for each primary pattern 18 and all secondary patterns formed by the newly added first game piece 6 or second game piece 7.

Figure 15:
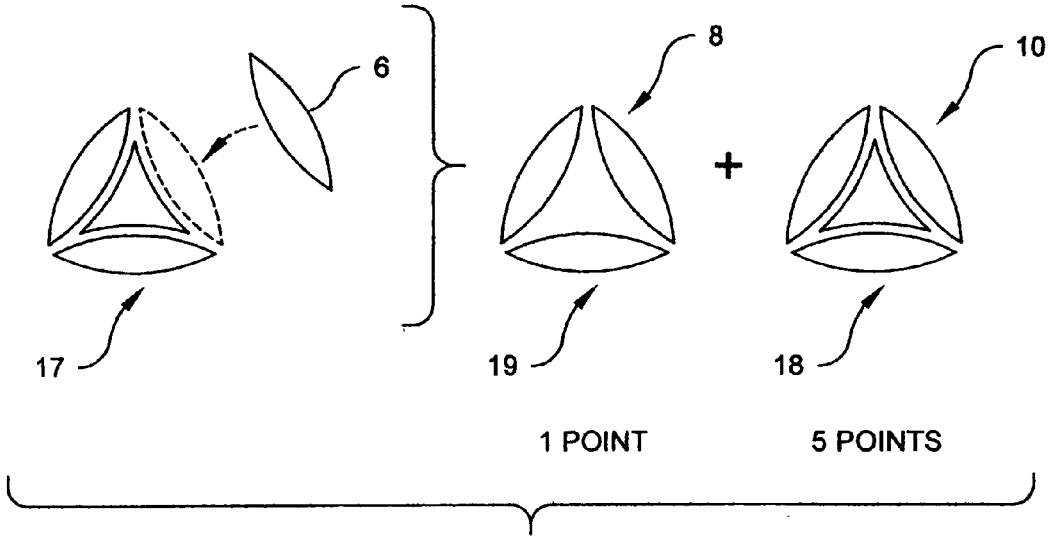
FIG. 15 is a plan view of an incomplete pattern prior to placement of a first game piece therein and the resultant primary and secondary patterns after completion of the pattern for scoring purposes.

FIG. 15 describes an incomplete pattern 17 comprising a gem pattern 10 prior to the insertion of a first game piece 6. For scoring purposes, the resultant primary pattern 18 is the identified gem pattern 10 and resultant secondary pattern 19 includes a triangle pattern 8.

Figure 16:
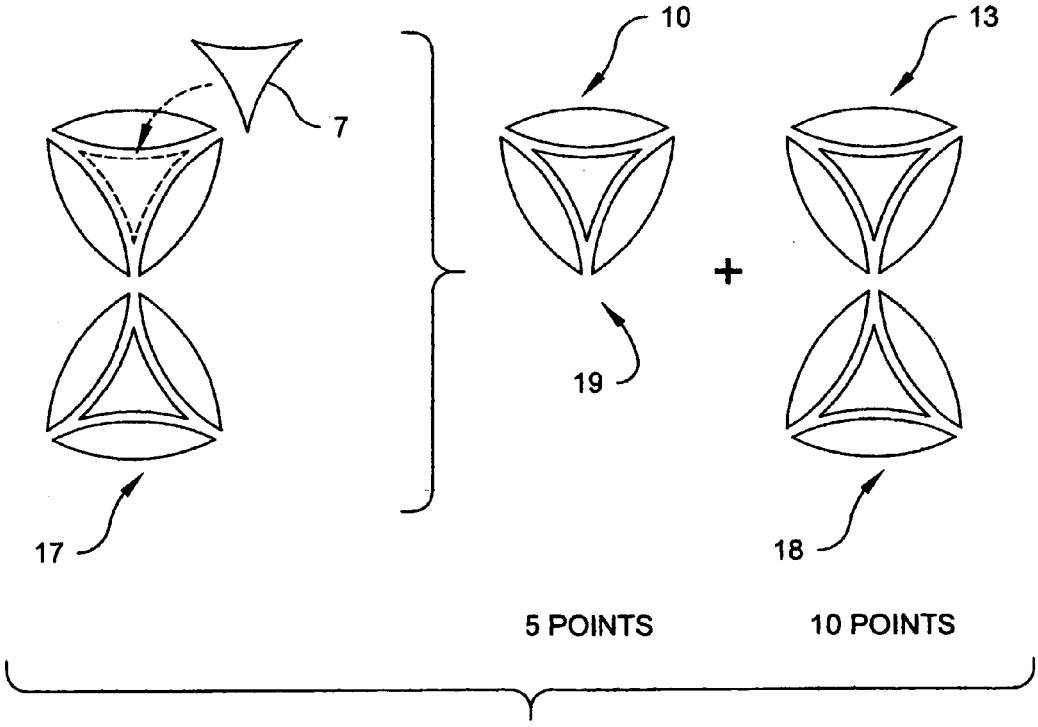
FIG. 16 is a plan view of an incomplete pattern prior to placement of a second game piece therein and the resultant primary and secondary patterns after completion of the pattern for scoring purposes.

FIG. 16 describes an incomplete pattern 17 comprising an hourglass pattern 13 prior to the insertion of a second game piece 7. For scoring purposes, the resultant primary pattern 18 is the identified hourglass pattern 13 and resultant secondary pattern 19 includes a single gem pattern 10.

Figure 17:
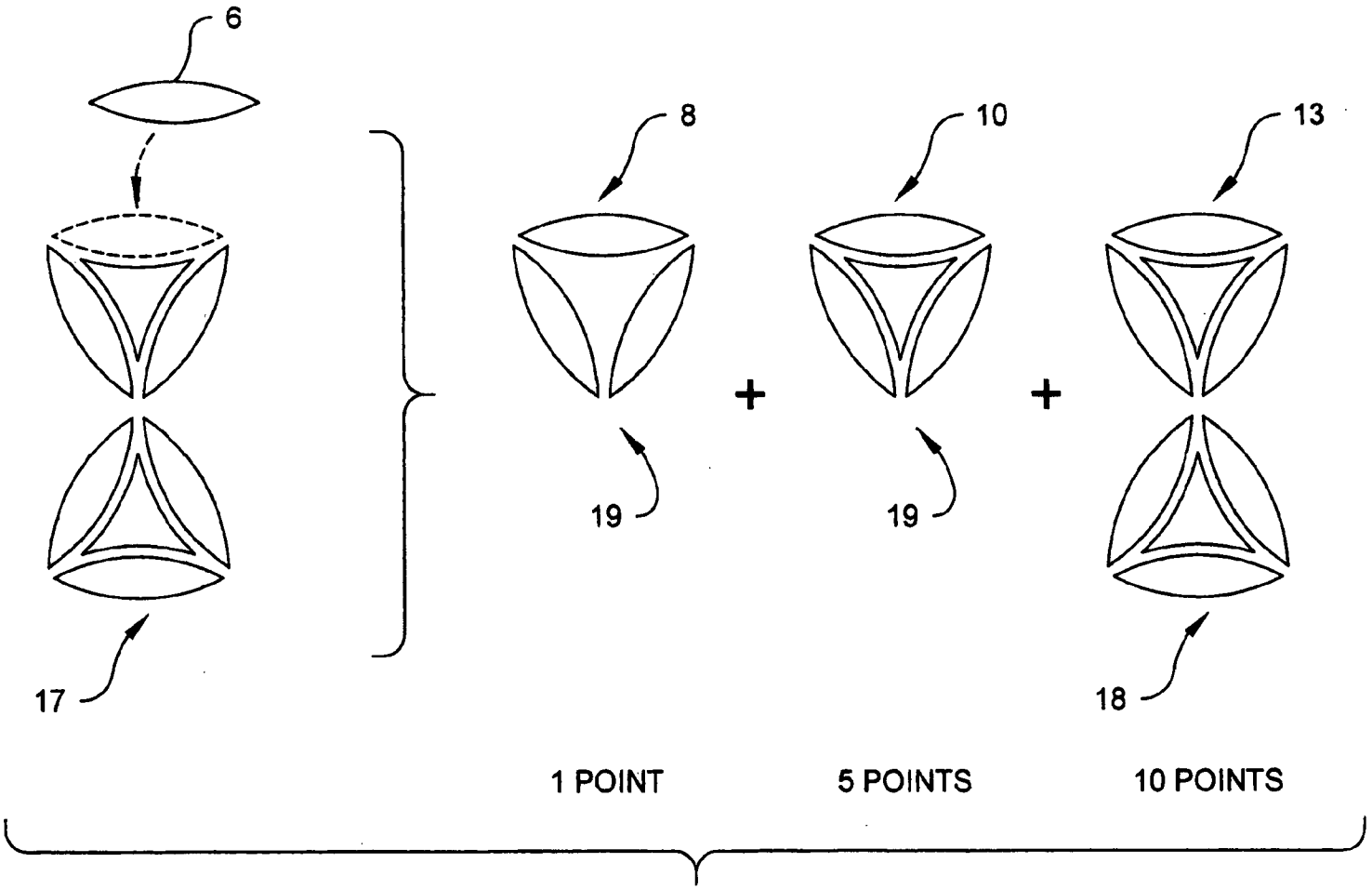
FIG. 17 is a plan view of an incomplete pattern prior to placement of a first game piece therein and the resultant primary and two secondary patterns after completion of the pattern for scoring purposes.

FIG. 17 describes another incomplete pattern 17 comprising an hourglass pattern prior to the insertion of a first game piece 6. For scoring purposes, the resultant primary pattern 18 is the identified hourglass pattern 13 and resultant secondary patterns 19 include a triangle pattern 8 and a gem pattern 10.

Figure 18:
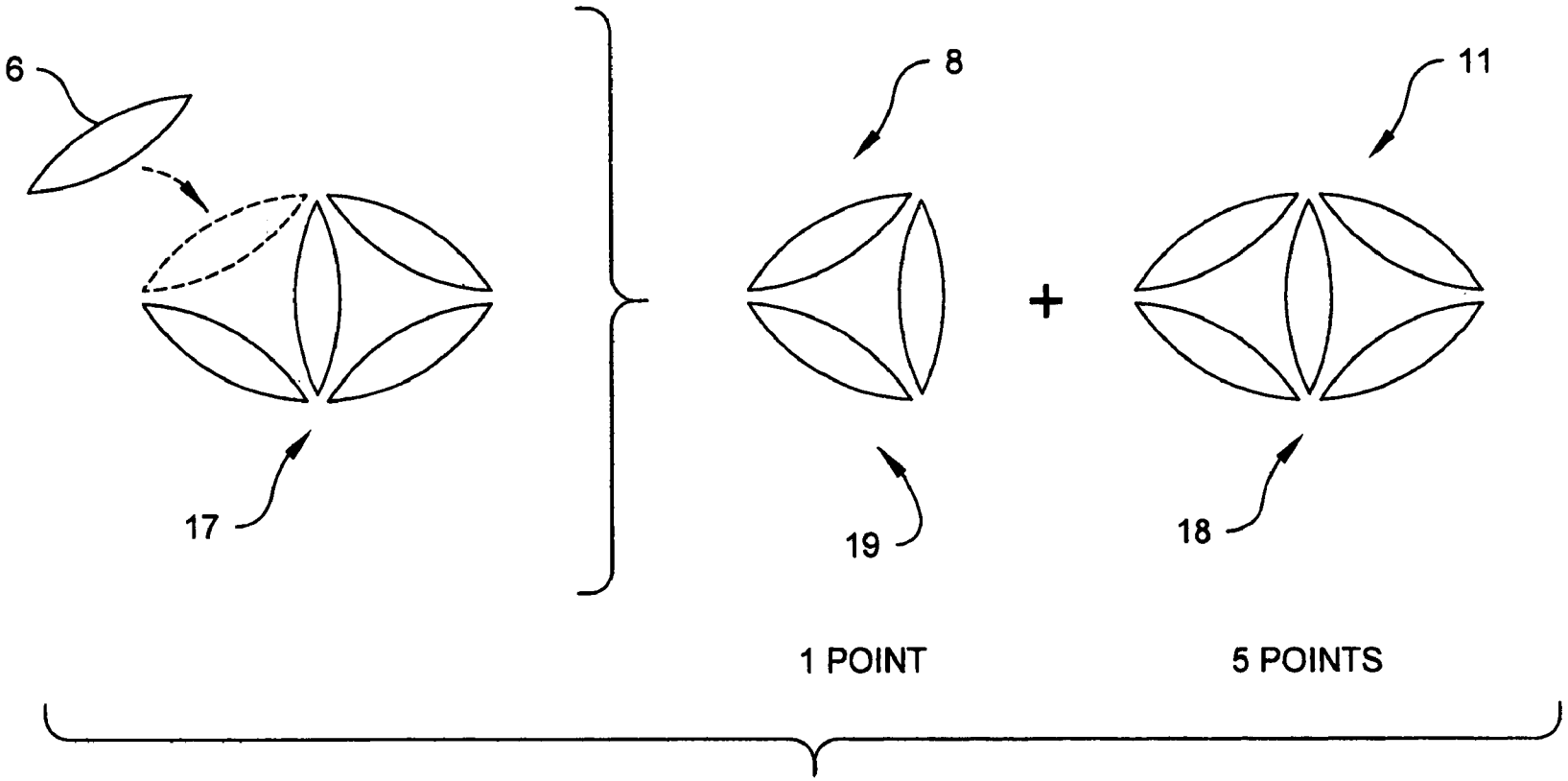
FIG. 18 is a plan view of an incomplete pattern prior to placement of a first game piece therein and the resultant primary and secondary patterns after completion of the pattern for scoring purposes.

FIG. 18 describes an incomplete pattern 17 comprising an eye pattern 11 prior to the insertion of an outer first game piece 6. For scoring purposes, the resultant primary pattern 18 is the identified eye pattern 11 and resultant secondary pattern 19 includes a triangle 8.

Figure 19:
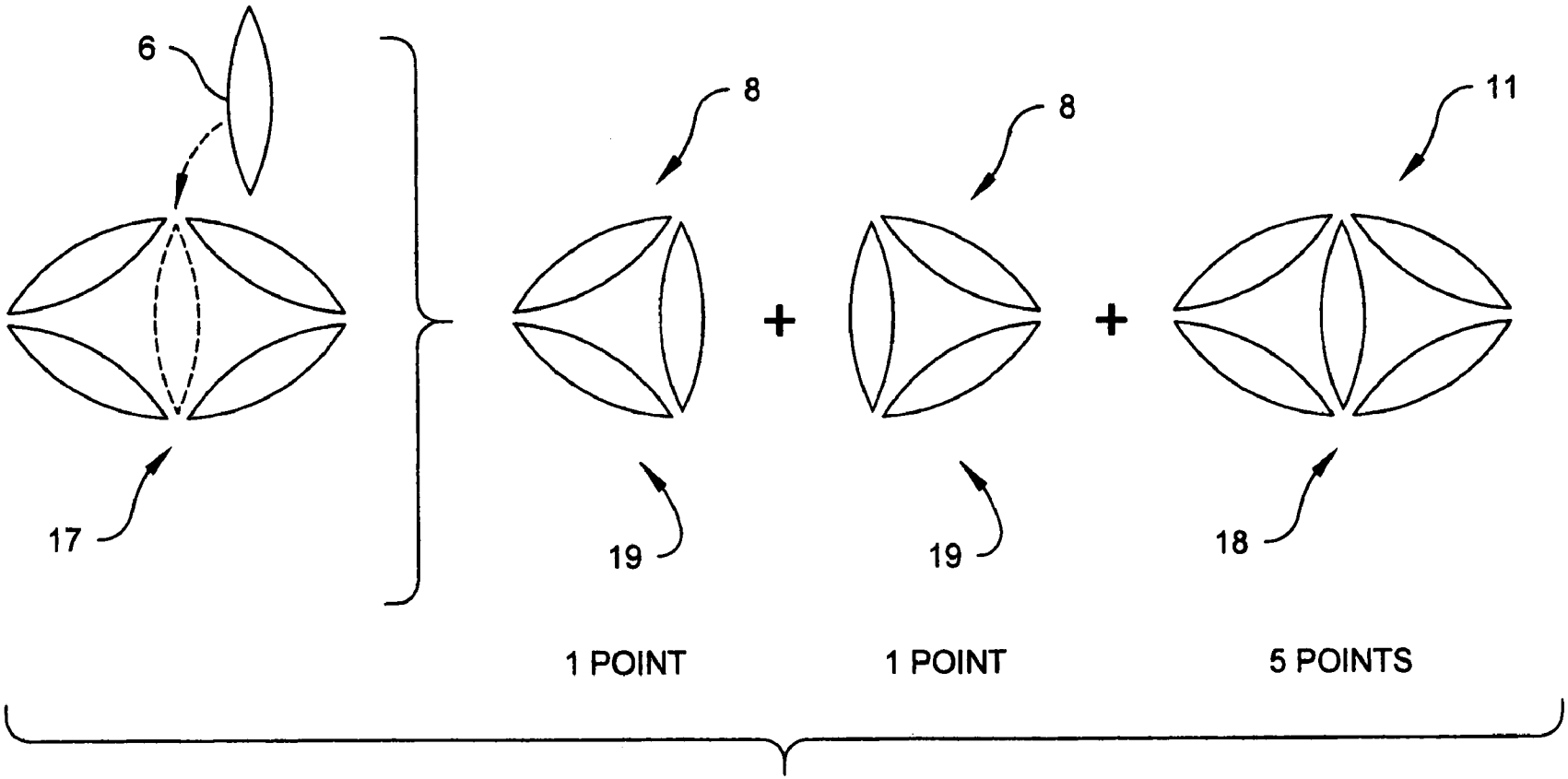
FIG. 19 is a plan view of an incomplete pattern prior to placement of a first game piece therein and the resultant primary and two secondary patterns after completion of the pattern for scoring purposes.

FIG. 19 describes an incomplete pattern 17 comprising an eye pattern 11 prior to the insertion of the innermost first game piece 6. For scoring purposes, the resultant primary pattern 18 is the identified eye pattern 11 and resultant secondary patterns 19 include a pair of triangle patterns 8.

Figure 20:
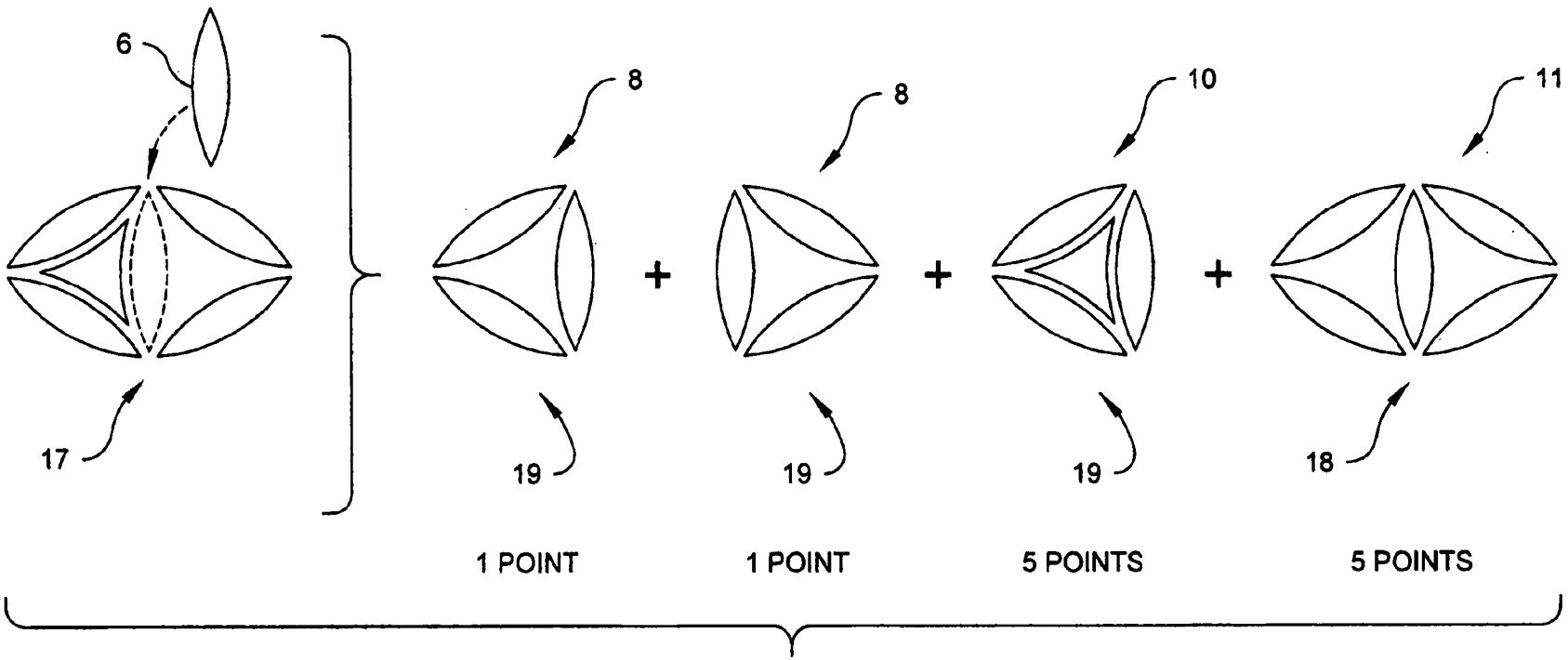
FIG. 20 is a plan view of an incomplete pattern prior to placement of a first game piece and the resultant primary and three secondary patterns after completion of the pattern for scoring purposes.

FIG. 20 describes an incomplete pattern 17 comprising an eye pattern 11 with a single second game piece 7 residing within one of the two second spaces 22 therein prior to insertion of the innermost first game piece 6. For scoring purposes, the resultant primary pattern 18 is the identified eye pattern 11 and three secondary patterns 19 including two triangle patterns 8 and one gem pattern 10.

Referring now to FIG. 21, an exemplary score sheet 20 is shown for the recordation of patterns and scores there from for two players or teams. The score sheet 20 graphically identifies the primary patterns 18 and secondary patterns 19 described above in a leftmost column for each player or team. A score tally column is provided to the right of the pattern identifiers. A player or team places a tally mark within this column next to the pattern formed. A value column is provided to the right of the score tally column so as to properly identify the points received for each pattern as defined by the rules. A points column is provided to the right of the value column to record the total points scored for each pattern at the conclusion of the game. The total points scored for each pattern is calculated by multiplying the total number of patterns formed by its value. A total score is calculated by summing the products recorded in the points column for all nine patterns on the score sheet 20. The player or team with the highest total score is the winner.

The objective of the game is to score the most points using the first game pieces 6 and second game pieces 7 to create primary patterns 18 and secondary patterns 19. Triangle patterns 8, diamond patterns 9, gem patterns 10, and eye pattern 11 appear more frequently on the play area 3 and are more likely to be formed. As such, each is awarded a lower points value. Pyramid patterns 12, hourglass patterns 13, star patterns 14, circle patterns 15, and flower patterns 16 appear less frequently on the play area 3 and are less likely to be formed. As such, each is awarded a higher points value. While various game strategies are possible, placement of first and second game pieces 6, 7 may be offensive so as to form one or more patterns and/or defensive so as to prevent another from completing one or more patterns.

At the beginning of each game, players are separated individually or grouped into teams. It is preferred to have two individual players or two teams with two players each. The board game 1, as described above, is positioned on a table, floor, or other supportive surface so that the play area 3 and receptacles 4*a*–4*d* are visually and physically accessible to the players. First game pieces 6 and second game pieces 7 are physically divided into two or more groups based upon visual coding. As such, each group includes both first game pieces 6 and second game pieces 7 having a common coding, preferably color. Thereafter, individual players or teams take possession of their respective first and second game pieces 6 and 7 which may then be temporarily stored within the receptacles 4*a*–4*d* on the board 2.

Individual players or teams establish a mutually agreed to sequence of play including the player or team to begin play and the order of play thereafter. While a variety of methods are possible, play may begin with the player or team that rolls the highest or lowest number with a die or dice. Likewise, it is possible for the order of play to coincide with the number rolled by each player or team in an ascending or descending order. Alternatively, the order of play may include a clockwise or counter-clockwise sequence based upon the physical location of players or teams about the board game 1.

A player physically removes either a first game piece 6 or a second game piece 7 from a receptacle 4*a*–4*d* and thereafter places it onto the play area 3. As such, each first game piece 6 may be placed onto any unoccupied first space 21 and each second game piece 7 may be placed onto any unoccupied second space 22. For team play, players within a team may collectively strategize to arrive at the placement of first and second games pieces 6, 7. However, it is also possible for players within a team to independently select the placement of first and second game pieces 6, 7 so as to increase the challenge and complexity of game play.

After each placement, the player or team declares the formation of any primary patterns 18 and secondary patterns 19 formed by the newly added first game piece 6 or second game piece 7. It is likewise possible to have the players or teams identify all formed patterns at the end of game play or at selected times during play. However, it is preferred not to allow the inclusion of points for patterns made but noticed after the next player or team has taken its turn. Thereafter, the formation of any primary patterns 18 and secondary patterns 19 are duly recorded as a tally mark on a score sheet 20, as described above. A total score for each player is calculated as the game progresses or after no further primary patterns 18 are possible by any of the players or teams. The total score may be determined by first calculating a product for each of the patterns by multiplying the total number of tally marks therefore by the assigned point value and thereafter summing the products for all patterns.

It is readily apparent from the description above that the present invention may be implemented in an electronic format facilitating play and/or scoring.

The description above indicates that a great degree of flexibility is offered in terms of the present invention. Although the present invention has been described in considerable detail with reference to certain preferred versions thereof, other versions are possible. Therefore, the spirit and scope of the appended claims should not be limited to the description of the preferred versions contained herein.

What is claimed is:

1. A pattern formation board game comprising:

(a) a board having a play area substantially planar in extent;

(b) a plurality of overlapping substantially triangular patterns disposed on said play area, each said substantially triangular pattern comprising three first spaces each being elliptically shaped having a symmetric perimeter composed of a pair of convex sides and one second space having a perimeter composed of three concave sides, said concave sides being substantial similar to said convex sides, said second space surrounded by three said first spaces, each two abutting said substantially triangular patterns sharing one said first space, six said substantially triangular patterns arranged so that six said first shapes form a circle pattern, six said first shapes form a flower pattern within said circle pattern, and six said second shapes form a star pattern within said circle pattern;

(c) a plurality of first game pieces substantially identical in shape and size to said first spaces and having a visual code thereon, each said first game piece non-movable after placement onto said first space; and (d) a plurality of second game pieces substantially identical in shape and size to said second spaces and having said visual code thereon, each said second game piece non-movable after placement onto said second space.

2. The pattern formation board game of claim 1, wherein said boundary is an image.

3. The pattern formation board game of claim 1, wherein said boundary physically extends above said play area.

4. The pattern formation board game of claim 1, wherein each said convex side and each said concave side are curved.

5. The pattern formation board game of claim 1, wherein each said convex side and each said concave side are composed of at least two linear segments.

6. The pattern formation board game of claim 1, wherein said play area has fifty-four said substantially triangular patterns thereon.

7. The pattern formation board game of claim 1, further comprising:

(e) at least one receptacle disposed on said board adjacent to said play area.

8. The pattern formation board game of claim 7, wherein said boundary is an image.

9. The pattern formation board game of claim 7, wherein said boundary physically extends above said play area.

10. The pattern formation board game of claim 7, wherein each said convex side and each said concave side are curved.

11. The pattern formation board game of claim 7, wherein each said convex side and each said concave side are composed of at least two linear segments.

12. The pattern formation board game of claim 7, wherein said play area has fifty-four said substantially triangular patterns thereon.

13. A method of playing a pattern formation game, comprising the steps of:

(a) providing a board having a play area substantially planar in extent, said play area having a plurality of overlapping substantially triangular patterns thereon, each said substantially triangular pattern comprising three first spaces each being elliptically shaped having a symmetric perimeter composed of a pair of convex sides and one second space having a perimeter composed of three concave sides, said concave sides being substantial similar to said convex sides, said second space surrounded by three said first spaces, each two abutting said substantially triangular patterns sharing one said first space, six said substantially triangular patterns arranged so that six said first shapes form a circle pattern, six said first shapes form a flower pattern within said circle pattern, and six said second shapes form a star pattern within said circle pattern;

(b) providing a plurality of first game pieces substantially identical in shape and size to said first spaces and having a visual code thereon, each said first game piece non-movable after placement onto said first space;

(c) providing a plurality of second game pieces substantially identical in shape and size to said second spaces and having said visual code thereon, each said second game piece non-movable after placement onto said second space;

(d) dividing said first game pieces and said second game pieces between said players based upon said visual code;

(e) placing one of said first game pieces onto one said first space or one of said second game pieces onto one said second space in a sequential order of play;

(f) declaring formation of a primary pattern;

(g) declaring at least one secondary pattern when appropriate;

(h) recording said primary pattern and any said secondary patterns as a tally mark on a score sheet; and (i) calculating a total score for each said player after no further said primary patterns are possible.

14. The method of claim 13, wherein said calculating step further comprising the steps of:

(I) multiplying a total of said tally marks by a point value to arrive at a product for each of said primary patterns and each of said secondary patterns; and (II) summing said products for all said primary patterns and said secondary patterns.

15. The method of claim 13, wherein said primary patterns include a triangle pattern, a diamond pattern, a gem pattern, an eye pattern, a pyramid pattern, an hourglass pattern, a star pattern, a circle pattern, and a flower pattern.

16. The method of claim 15, wherein said secondary pattern includes at least one said triangle pattern.

17. The method of claim 15, wherein said secondary pattern includes said gem pattern.

18. The method of claim 15, wherein said primary patterns include at least one said triangle pattern and said gem pattern.

* * * * *